United States Patent [19]

Liesse

[11] 4,377,991

[45] Mar. 29, 1983

[54] INTERNAL COMBUSTION APPARATUS

[75] Inventor: Maurice Liesse, Saint-Denis-les-Sens, France

[73] Assignee: ANVAR Agence Nationale de Valorisation de la Recherche, Paris, France

[21] Appl. No.: 175,403

[22] Filed: Aug. 5, 1980

[30] Foreign Application Priority Data

Aug. 8, 1979 [FR] France ..... 79 20272

[51] Int. Cl.[3] ..... B25C 1/08

[52] U.S. Cl. ..... 123/46 SC; 123/47 R; 60/633

[58] Field of Search ..... 123/47 R, 47 A, 47 AA, 123/46 R, 46 SC; 60/632, 633

[56] References Cited

U.S. PATENT DOCUMENTS

| | | | |
|---|---|---|---|
| 1,707,005 | 3/1929 | Hall | 123/47 R |
| 2,139,457 | 12/1938 | Patchett | 123/47 A |
| 2,292,942 | 8/1942 | Horner | 123/46 SC |
| 3,042,008 | 7/1962 | Liesse | 123/46 SC |
| 4,027,632 | 6/1977 | Wagner | 123/47 R |
| 4,075,850 | 2/1978 | Nakazato et al. | 60/633 |
| 4,200,213 | 4/1980 | Liesse | 123/46 SC |
| 4,250,844 | 2/1981 | Tews | 123/47 A |

*Primary Examiner*—Craig R. Feinberg
*Attorney, Agent, or Firm*—Charles E. Brown

[57] ABSTRACT

An internal combustion apparatus is disclosed having a linear output. A metered quantity of gas fuel is transferred between a cylinder head and the disc of a plunger reciprocable in a principal chamber between top and bottom end of stroke positions. In the displacement of the plunger to its bottom end of stroke position air and fuel are intimately mixed in a one-way flow path around the disc including nonparallel and/or burred orifices in a perforate plate attached to the plunger. The fuel may be liquefied gas fuel in which case it may be vaporized by the combustion gases exhausted from the principal chamber to the surroundings through an annular exhaust zone coaxial of throttle passageways for carrying fuel from the metering piston to the principal chamber. Alternatively, a pressurized gas fuel may be used in which case the pressurized gas is utilized in the operation of the plunger.

17 Claims, 11 Drawing Figures

25
35
56A
53
F
56
36
f
63
34
33
32
40
30
31
70
R
71
22
11
V
20
20J
20G
20H
20F
50

27
85
70
73
74
F3
20
16
17
15
18
12
76
C1
10
21
80
11
25
71
F
V

INTERNAL COMBUSTION APPARATUS

The present invention relates to an internal combustion apparatus having a linear output.

The applicant has disclosed in his U.S. Pat. No. 4,200,213 issued on Apr. 29, 1980 a percussion apparatus comprising a percussion member associated with a main control piston displaceable in a cylinder and an auxiliary piston displaceable between top and bottom end of stroke positions. The auxiliary piston is adapted to temporarily store a metered quantity of fuel and in its bottom end of stroke piston defines a combustion chamber for the combustion mixture which is ignited. Exhaust means are provided for exhausting combustion gases.

Such an apparatus together with its fuel supply, e.g., a gas, and its ignition means may operate repeatedly automatically by actuating a trigger or one stroke at a time.

This apparatus has various applications in view of the reciprocating operation of the operating piston and very high force drive stroke and may be coupled to various accessories for driving nails, staples, studs or even injecting liquids.

An object of the present invention is to provide an apparatus of the same kind of relatively simplified construction as compared to the aforesaid apparatus. The present apparatus is complementary to the aforesaid apparatus to satisfy particular use requirements in which rapid automatic operation is not necessary.

According to the invention there is provided an internal combustion apparatus comprising a cylinder, a cylinder head arranged in said cylinder, a main operating piston reciprocable in said cylinder, resilient means for biasing said main piston toward a first or rest position, said main piston being adapted to be driven from its first position to an operating position in response to ignition of an explosive mixture, said main piston being operatively connected to an operating member, characterized in that it comprises a plunger reciprocably mounted in a principal chamber in said cylinder defined by a spaced formed between said main piston and said cylinder head between a top end of stroke position and a bottom end of stroke position, inlet means for admitting gas fuel and inlet means for admitting combustion supporting gas into an admission chamber formed between said cylinder head and said plunger in the course of its displacement between said top end of stroke position and its bottom end of stroke position, and a combustion chamber defined between said main operating piston and said plunger during its displacement from its bottom end of stroke position and its top end of stroke position, and one-way flow path means provided on said plunger operative in the course of displacement of said plunger between its bottom end of stroke position and its top end of stroke position to transfer the explosive mixture of fuel and combustion supporting gas to said combustion chamber.

Preferably the plunger is manually operated between the top end of stroke position and the bottom end of stroke position so that the fuel and combustion supporting gas, namely air, are gradually admitted into the admission chamber thus formed thereby producing a premixture of the fuel and air during the displacement of the plunger. But as this premixture does not constitute a perfectly homogeneous mixture the one-way flow path means intervenes during displacement of the plunger from its bottom end of stroke position to its top end of stroke position to ensure a particularly effective and intimate mixing of the components of the premixture. This one-way flow path means is adapted to cause turbulence in the combustion chamber during the displacement of the plunger toward its top end of stroke position, the explosive mixture being ignited while under the effect of turbulent motion, when the plunger reaches its top end of stroke position.

The one-way flow path means advantageously comprises in combination a perforate member forming a space with the end of the plunger facing the main piston and a sealing member disposed in a recess formed between the perforate member and the plunger having a first position bearing against the plunger and a second position bearing against the perforate member, the first corresponding to the admission of the fuel and air mixture into the admission chamber and the second position corresponding to the formation of the explosive mixture.

The intimate mixing effected during the displacement of the plunger from its bottom end of stroke position to its top end of stroke position where the explosive mixture is ignited there is no dead time so that the explosive mixture is ignited under the best possible conditions is linked to and simultaneous with the plunger reaching its top end of stroke position and the mixture is still in motion.

Such features therefore result in an efficiency of the apparatus from the standpoint of the thrust imparted to the main operating piston.

Preferably, the plunger is connected to a fuel supply tank via a column having push button adapted to deliver a metered quality of fuel when actuated; the column also has an exhaust valve for permitting the escape of the combustion gases while heating a throttle passageway for the flow of the metered fuel.

The resulting embodiment is thus compact and of simple construction, and not only is the metering of the fuel totally satisfactory but also it readied for combustion by its flow through the passageway. Combustion supporting air is of course metered by a suitably sized throttle orifice.

According to another aspect of the invention there is provided an internal combustion apparatus comprising a cylinder having a cylinder head, a main operating piston displaceable in the cylinder between a first or rest position and a second, operating position, said operating piston being adapted to be driven from its first position to said operating position in response to ignition of an explosive mixture of combustion supporting gas and a metered quantity of fuel confined between said cylinder head and said operating piston, characterized in that it comprises a plunger reciprocably mounted in a principal chamber in said cylinder limited on one side by said cylinder head between a top end of stroke position and a bottom end of stroke position, a source of fuel, means for metering said fuel and transferring it to an admission chamber, and means for admitting air into said admission chamber, means for intimately mixing the gas fuel with the combustion supporting gas connected for displacement with said plunger between one of its end of stroke positions to the other end of stroke position, means for igniting the intimately mixed explosive mixture.

In brief, apparatus according to the present invention thus provides an internal combustion apparatus which is reliable and adapted to the particular tasks to be accomplished.

These and other features and advantages of the invention will become apparent from the description which follows, given by way of example, with reference to the accompanying sheets of drawings in which.

Figure 2:
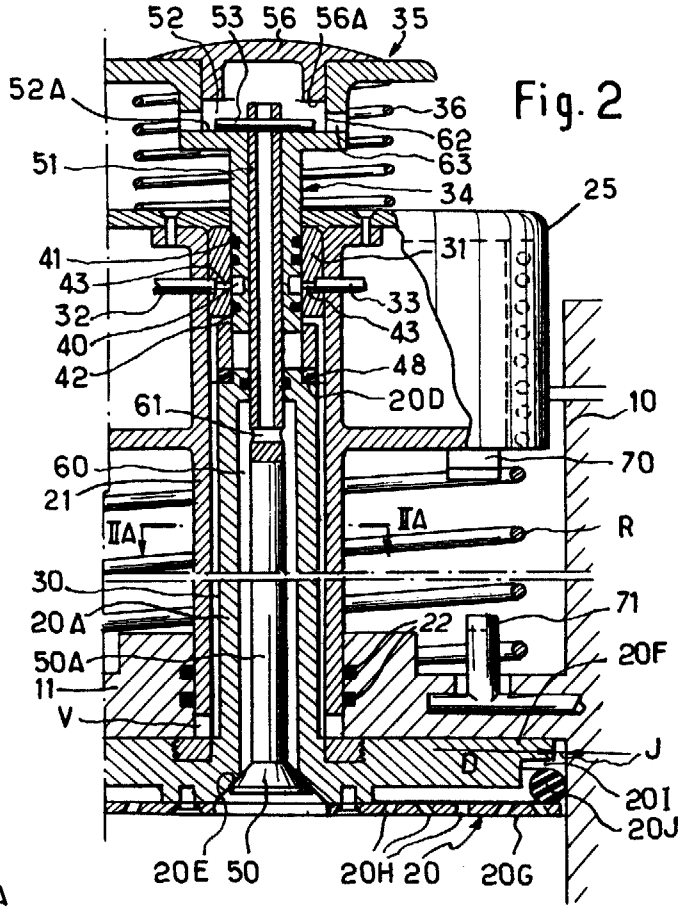
FIG. 2 is an enlarged view of the part enclosed in the phantom line box indicated II in FIG. 1.

In the embodiment illustrated in FIGS. 1-6, the internal combustion apparatus comprises a cylinder 10 having an intermediate cylinder head 11 defining with a main control piston 12 in its raised or rest position in a principal chamber C. The main piston 12 is displaceable in cylinder 10 between its raised or top end of stroke position determined by a peripheral abutment 13 and a bottom end of stroke position determined by the threaded cylinder endwall 14 provided with a damping ring 15.

The main piston 12 is equipped with an operating member such as a percussion rod or striker 16 adapted to drive an article such as a nail or the like or strike or operate an accessory adapted to be associated with the internal combustion apparatus. The cylinder endwall 14 also comprises a guide 17 for the percussion rod or striker 16 and a coil spring 18 is interposed between the main piston 12 and the cylinder endwall 14.

In the principal chamber C is disposed a plunger designated by general reference numeral 20 and described in greater detail hereinbelow. The plunger 20 is slidable inside a column 21 which in turn is slidable at one end in the cylinder head 11 with sealing members 22 interposed therebetween, the other end of the column 21 comprising a fuel supply tank 25 for a liquefied gas fuel such as butane or propane.

A handle or grip 26 is fixed to the cylinder 10 and accommodates an ignition device 27 of a known type such as the one disclosed in U.S. Pat. No. 3,193,642 granted July 6, 1965 to the applicant.

Figure 2A:
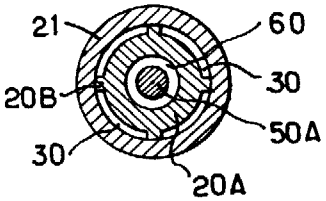
FIG 2A is a cross-sectional view taken on line IIA—IIA in FIG. 2.

With particular reference to FIGS. 2 and 2A the plunger 20 has a cylindrical sleeve or extension 20A having a plurality of longitudinal splines along its outer surface, e.g. four as shown in FIG. 2A, defining with the inner surface of the column 21 an equal number of throttle passageways 30 for fuel.

The column 21 houses above the cylindrical sleeve 20A a ring 31 fixed to the column by means of the rigid ends of two tubes 32 and 33 immersed in the tank. A metering piston 34 is slidable in this ring which terminates by push button operator 35 biased by a return spring 36 interposed between the push button operator 35 and the upper side of the tank 25.

The metering of the fuel for an operating cycle is determined by a circular annular groove 40 to each side of which are sealing members 41 and 42 adapted to form a fluidtight seal between the metering piston and the ring 31. The ring 31 comprises two radial passageways 43 adapted to put the tubes 32 and 33 into communication with the aforesaid groove 40.

A sealing member 48 is disposed at the top of the sleeve 20A which has for this purpose a bearing shoulder 20D. The plunger 20 has at the center of its lower end a seat 20E for a valve member 50 the shank 50A of which is controlled by the push button operator 35. For this purpose the upper end of the valve rod 50A is coupled to the lower end of a tubular member 51 whereas the upper end of the tubular member 51 which opens into a chamber 52 is held captive by means of a pin 53 transversely extending through the tubular member between a bearing surface 56A on a cap 56 closing off the chamber 5 and the bottom wall 52A of the chamber formed on the metering piston 34.

During the stroke of the valve rod 50A in the sleeve 20A the valve rod defines with the inner surface of the sleeve 20A an annular exhaust zone 60 for exhausting the combustion gases.

The annular zone 60 is brought into communication with the annular member 51 via channel 61 while the end of the tubular element opens into the chamber 52 which communicates with the atmosphere through radial holes 63 in the sidewall of the push button 35. Thus exhaust gases follow the path comprising the annular exhaust zone 60, channels 61, tubular member 51 and holes 62 and 63.

It will be noted that the hot exhaust gases passing through the annular exhaust zone 60 heat the sleeve 20A and thereby the throttle passageways 30 for the fuel so that the fuel is vaporized before admission into annular recess V formed in the column 21 at the end facing the cylinder head 11 and the plunger 20 when the latter is in its top end of stroke position as illustrated in FIG. 2.

The plunger 20 further comprises a circular disc 20F having a diameter D adapted to be slidingly received in a principal chamber in cylinder 10 with play J. A perforate plate 20G is provided on the side of the disc 20F facing the main piston 12 and has a plurality of orifices 20H the axes of which are not parallel to one another. The contours of these orifices may also have burrs. The disc 20F has a peripheral groove or recess 20I adapted to accommodate in part an O-ring 20J defining a sealing member. The O-ring 20J is advantageously made of self-lubricating, high temperature resistant rubber.

Complementary latch means are provided for latching the fuel tank relative to the cylinder head 11. To this end the fuel supply tank 25 (see FIG. 1) has on its underside a retaining means such as a ring or latch 70 adapted to cooperate with a pawl 71 fixed to a rod 72 rotatably mounted in the cylinder head 11, the rod 72 is connected by means of a linkage 73 to a trigger 74 pivotally mounted on a pivot 75 in the handle or grip 26.

Cylinder 10 is equipped with one or more spark plugs 76 immediately above the main piston 12 in its raised position connected to the ignition control means 27 also housed in the handle or grip 26.

Figure 1:
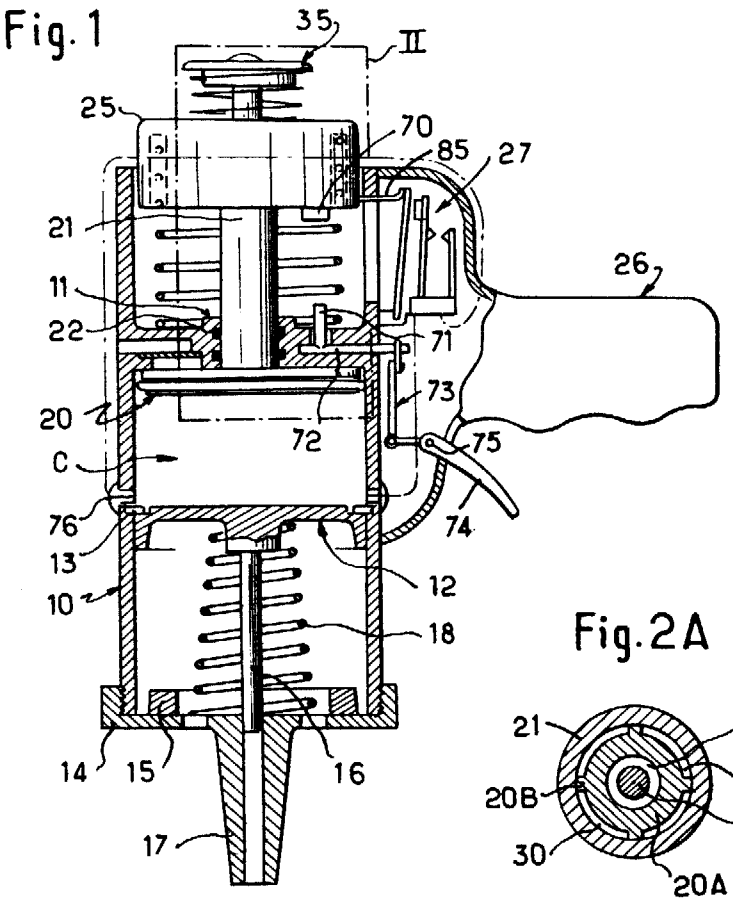
FIG. 1 shows a schematic longitudinal sectional view of an apparatus embodying the present invention.

The operation of the apparatus will now be described with respect to FIGS. 1 and 2 illustrating the apparatus in its position of repose.

In the repose position the plunger 20 is in its top end of stroke position, the push button 35, the metering piston 34 and the exhaust valve member 50 are also in their corresponding raised positions; in the raised or closed position of the valve member 50 the bottom wall 52A of the chamber 52 urges the pin 53 upwardly under the biasing force of the spring 36 cooperating with the push button 35.

The fuel may be admitted into the metering groove 40 since the latter is in position facing the fuel inlets 32 and 33.

Figure 3:
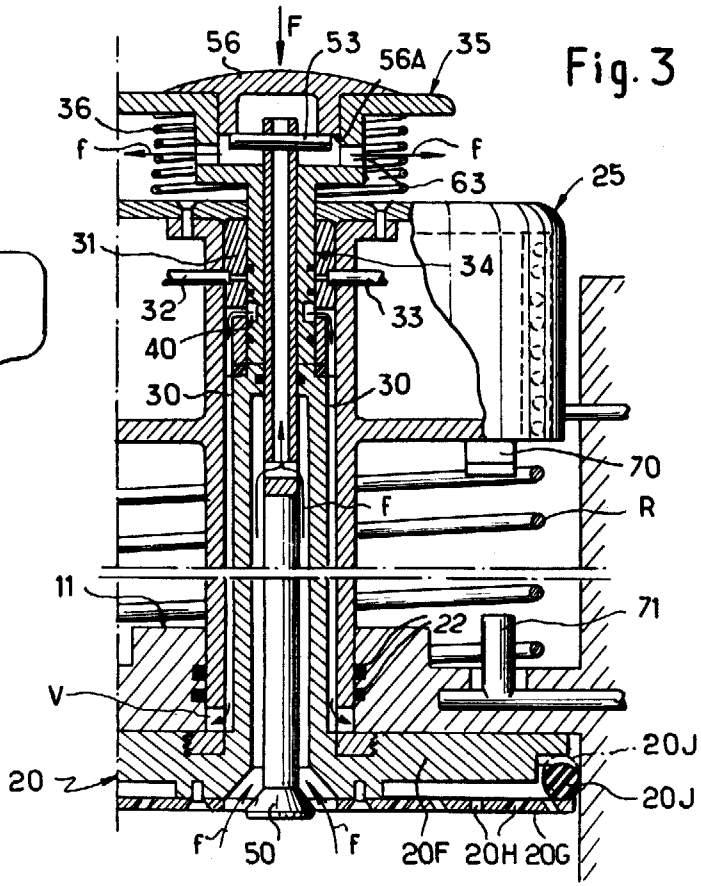
FIG. 3 is a view similar to FIG. 2 in which the fuel metering pushrod is depressed.

In a first step of the operating cycle the push button 35 is depressed as indicated by arrow F in FIG. 3, which brings the metering groove 40 into facing relation with the throttle passageways 30 so that the liquefied gas flows through the passageways 30 where it is vaporized before reaching the annular recess V; the exhaust valve member 50 is opened by means of the bearing surface 56A of the cap 56 exerting a downward force on the pin 53 whereby the combustion gas, which is substantially entirely $CO_2$ and water vapor, owing to the fact that combustion is substantially perfect, rises in the annular exhaust zone 60 heating the sleeve 20A through the channel 61 into and up the tubular member 51 to the chamber 52 and out the radial holes 63 to the surroundings as indicated by arrows f.

It is to be noted that the return spring 36 biasing the push button 35 to its rest position is weaker than the return spring R interposed between the underside of the fuel supply tank 25 and the cylinder head 11.

Figure 4:
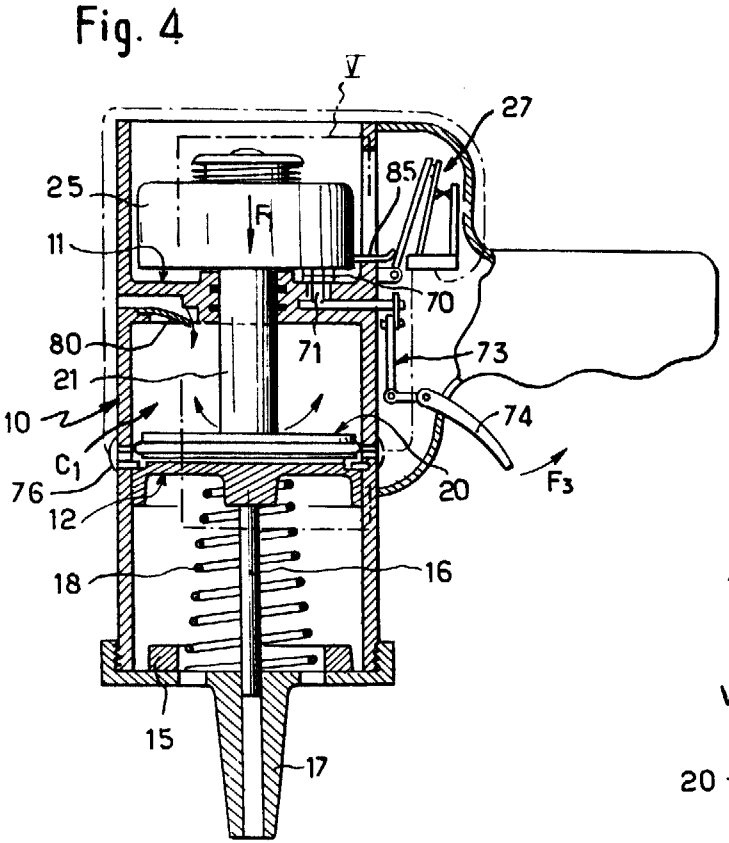
FIG. 4 is a view similar to FIG. 1 of the apparatus in the course of an operating cycle, the plunger being in its bottom end of stroke position.
Figure 5:
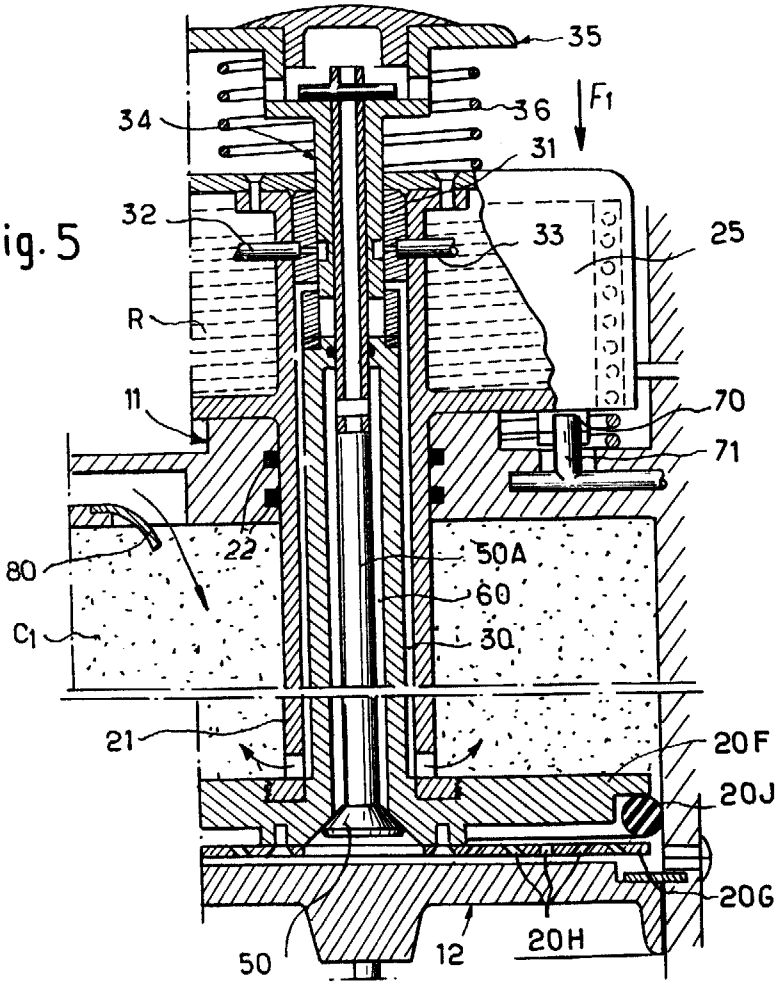
FIG. 5 is a fragmentary view of an enlarged scale of the part enclosed in the phantom line box designated V in FIG. 4.

By further downward displacement of the push button 35 as indicated by arrow $F_1$ in FIGS. 4 and 5 the unit comprising the fuel supply tank 25, column 21 and plunger 20 which is received inside the cylinder 10 is displaced in the chamber C toward the main piston unitl the plunger 20 reaches the immediate vicinity of the main piston and is thus arrested in its bottom end of stroke position by the complementary latch means comprising the retaining member 70 and the pawl 71. During the operating step the gas fuel is admitted into the admission space C1 thus defined between the cylinder head 11 and the disc 20F of the plunger 20 while the combustion supporting gas, here air, is sucked into the admission space C1 through a deformable flap 80 or check valve provided in a passage through the cylinder head 11 to the surroundings. Alternatively the passage through the cylinder head 11 may be connected to a source of combustion supporting oxygen instead of air via a hose not shown.

During this operating step the O-ring 20J bears against the disc 20F as is best seen in phantom lines in FIG. 3 and the combustion gases are scavenged in front of the disc 20F and exit through the space between the valve member 50 and its seat 20E.

The push button 35 is released and the valve member 50 closes against its seat under the biasing force of its spring 36 thereby returning the various slidable parts to the position indicated in FIG. 5.

By pulling trigger 74 in the direction of arrow F3 (FIG. 4) the pawl 71 releases the latch ring 70 thereby causing the abrupt return of the plunger 20 to its top end of stroke position under the action of the precompressed return spring R.

Figure 6:
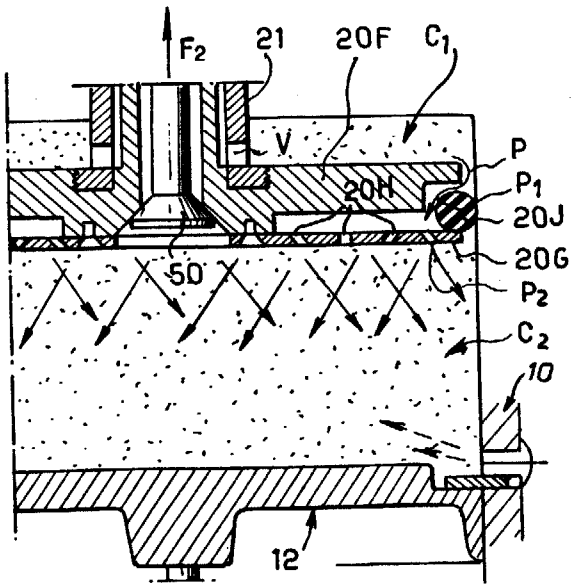
FIG. 6 is a fragmentary view of the apparatus in the course of operation, the plunger being displaced from its bottom end of stroke position to its top end of stroke position.

FIG. 6 illustrates the upwards return movement of the plunger 20. During the upwards movement of the plunger 20 in the direction $F_2$ the premixed combustion supporting gas and gas fuel in the space C1 between the opposed faces of the disc 20 and the cylinder head 11 is transferred to the combustion space C2 formed in the course of the displacement of the plunger in the cylinder 10. During upwards displacement of the plunger 20 the air and the gas fuel are intimately mixed to constitute a homogeneous combustion mixture. The intimate mixing of the combustion supporting air and the gas fuel is obtained by the streaming of the premixed gases from the admission chamber C1 around the plunger disc 20F through communicating passages P, P1 and P2 which are defined respectively by the space between the peripheral edge of the disc 20F and the cylinder 10, by the space between the O-ring 20J and the disc 20F and the orifices 20H in the perforate member 20G. The nonparallel orifices 20H form criss-crossing streams of the premixed gas creating swirling motion of the gas downstream of the perforate member 20G as the combustion chamber C2 is formed by the space between the perforate member 20G and the main piston 12. Alternatively the burrs along the contours of even parallel orifices may provide the required turbulence.

When the plunger is in its top end of stroke position an actuating arm 85 associated with the fuel supply tank 25 actuates an ignition control means 27 supplying current to the spark plugs 76 producing an arc which ignites the explosive mixture which is still in motion.

It will be understood that the explosion of the explosive mixture suddenly thrusts the main operating piston 12 against the action of the return spring 18 and thereby drives the operating member 16, or other operating member which may be associated with an accessory, adapted to drive nails, staples and studs or to inject liquid, or the like requiring a linear output. The present invention is not intended to be limited to any particular use of the present apparatus.

The apparatus just described is of a one-stroke-at-time operation, i.e. a single operating cycle is set into motion each time the push button is depressed and the trigger is pulled.

Reference will now be made to an alternative embodiment illustrated in FIG. 7.

The same references are used to designate similar parts to those disclosed with relation to FIGS. 1-6. The alternative embodiment differentiates from that of FIGS. 1-6 by the fact that the pressurized gas fuel itself is used to drive the plunger from its top end of stroke position to its bottom end of stroke rest position.

To this end the handle 26 houses a pressurized supply tank of gas fuel e.g. acetylene or even hydrogen, which is connected to a two-way valve 93 via a pressure reducing valve 91 and conduit 92. The two-way valve 93 is controlled by a trigger 95 associated with a linkage 96. The two-way valve 93 has a first outlet connected to a conduit 97 communicating with a tubular member 98 axially fixed relative to the cylinder, a second outlet communicating with a conduit 99 opening into the chamber defined between the cylinder head 11 and the plunger 20.

According to this embodiment the plunger 20 comprises an upwardly directly tubular extension 101 having sealing members 102 operative between it and the aforesaid tubular member 98 and slidable along the latter. A return spring 103 bears between the cylinder head 11 and a flanged disc 104 fixed to the upper end of the tubular extension 101 biasing the plunger to its top end of stroke position.

The cylinder head 11 houses a tripping mechanism 105 adapted to be actuated by the lower disc 104 of the plunger 20. A deformable flap or check valve 106 is mounted in a passage connecting the chamber C with the surroundings. The endwall of the cylinder 10 is provided with an orifice 107 for bringing the top side of the upper disc 104 of the plunger 20 into communication with the atmosphere.

The valve 120 includes a valve member 120E slidably mounted radially with respect to the cylinder 10 in a valve body 120A affixed to the cylinder comprising a valve seat 120B and exhaust ports 120C for evacuating the products of combustion. A spring 120D biases the valve member 120E to its closed position in contact with valve seat 120B to return the valve member 120E to this position once the trigger 95 is pulled.

Figures 7, 7A, 8, 9:
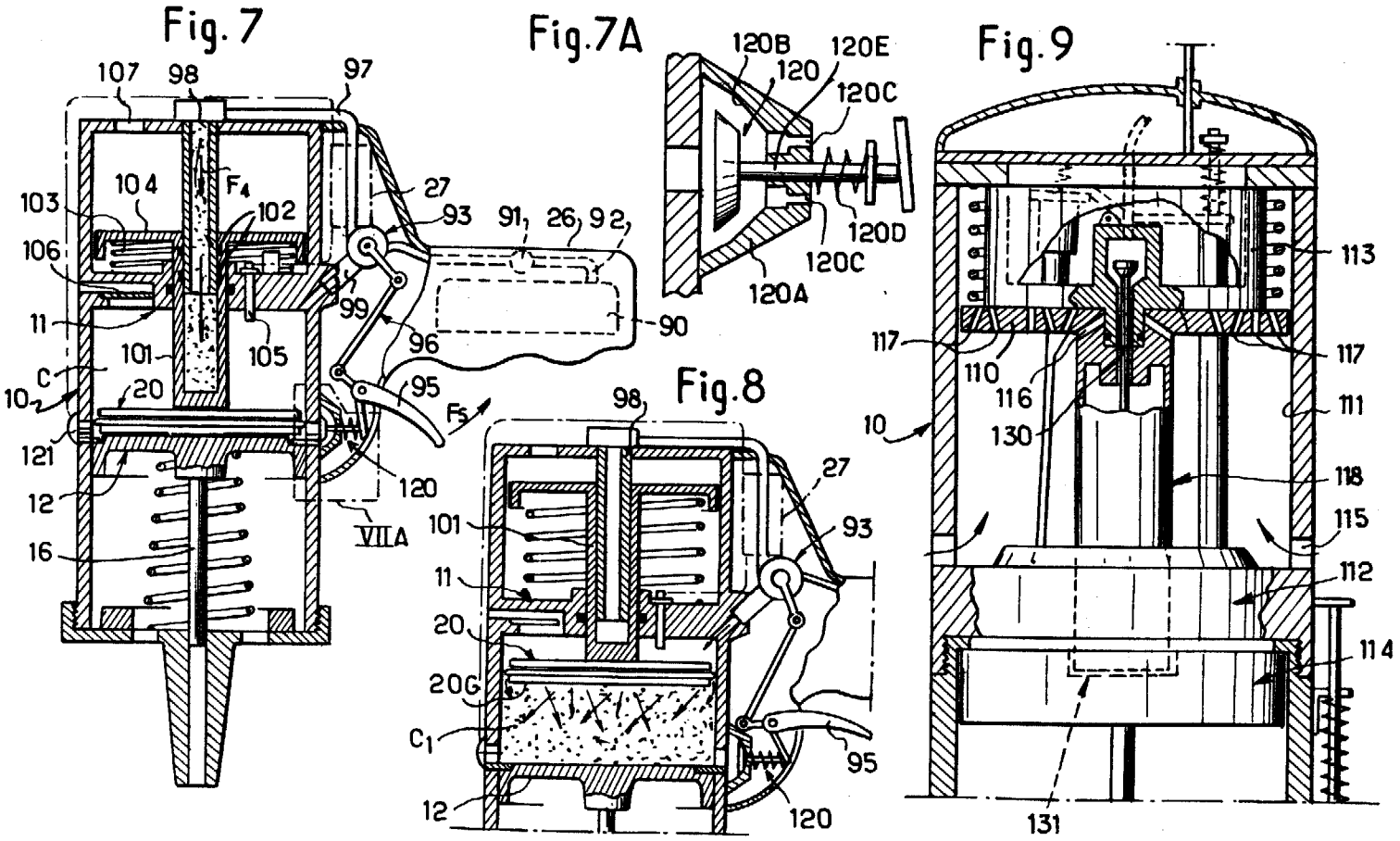
FIG. 7 shows an alternative embodiment of the apparatus in its repose position.
FIG. 7A is a fragmentary view of the phantom line box designated VII A in FIG. 7.
FIG. 8 is view similar to FIG. 7 for the apparatus in the course of operation.
FIG. 9 shows another alternative embodiment of the apparatus.

The apparatus of this alternative embodiment operates as follows:

In FIG. 7 the various parts are shown in their cocked position, the plunger 20 being in its bottom end of stroke position owing to the fact that the two-way valve 93 is adapted to deliver pressurized fuel to the tubular member 98 as indicated by the arrow F4 while the valve 120 is open before the trigger 95 is pulled. As long as the trigger is not released the plunger 20 remains in its bottom end of stroke position and air at ambient pressure is admitted into chamber C defined between the cylinder head 11 and the lower disc of the plunger 20.

When the operator pulls trigger 95 in the direction of arrow F5 the linkage 96 simultaneously controls the two-way valve 93 and valve 120. Two-way valve 93 cuts the supply of pressurized gas to the tubular member 98 and brings the tubular member 93 into communication with conduit 99 and thereby chamber C whereby a metered quantity of gas in the tubular member 98, tubular portion 101 of the plunger 20 and conduit 97 is transferred to the chamber C. The exhaust valve 120 closes at this point under the action of its spring 120D.

In view of the fact that the pressure in the tubular member 98 is released by the flow of gas fuel into chamber C (see FIG. 8) the plunger 20 is brought from its bottom end of stroke position to its top end of stroke position under the action of spring 103. During the displacement of the plunger 20 the metered quantity is admitted into the chamber C filled with air between the cylinder head 11 and the plunger 20. In the course of this displacement of the plunger 20 the explosive mixture fills the combustion chamber C1 by the flow of air and gas through the one-way flow path means around the peripheral edge of the lower disc of the plunger 20 as shown in greater detail in FIGS. 1–6 and described hereinabove.

When the plunger 20 reaches its top end of stroke position it engages the actuator 105 which supplies current over conductors to the ignition control means 27 and thereby to the spark plugs 121.

The explosive mixture in the chamber C1 is ignited while the explosive mixture is still in swirling motion caused by the orifices in the perforate member 20G. The explosion of the mixture suddenly drives the main operating piston 12 from its raised position of repose to its operating position thereby driving its associated percussion member 16 or the like.

The operating cycle is completed when the operator releases the trigger 95, the various movable parts automatically returning to their cocked position for another operating cycle as shown in FIG. 7. This embodiment is necessarily automatic to the extent that it is not necessary to cock it manually but it requires a pressurized source of gas fuel unlike the embodiment of FIGS. 1–6 which employs a liquefied gas such as butane or propane.

In the two embodiments which have already been described the plunger 20 disposed between the cylinder head 18 and the main operating piston 12 is adapted to form in the principal chamber C an admission chamber C1 when the plunger is in its bottom end of stroke position and a combustion chamber C2 when the plunger is in its top end of stroke position. Nevertheless the principal chamber inside which the plunger is displaceable may be arranged differently.

In applicant's earlier U.S. Pat. No. 4,200,213 issued Apr. 29, 1980 incorporated herein by reference, there is disclosed an apparatus in which the air is admitted in a separate chamber from the combustion chamber and is mixed with the fuel during the displacement of a plunger fixed to an auxiliary piston.

This construction is schematically illustrated in FIG. 9 in which the perforate plate 110 fixed to the metering auxiliary piston 118 is displaceable in a cylinder 111 between one side of the cylinder head 112 and the underside of cylinder 113 while the main operating piston 114 is disposed in the cylinder with a face opposite the cylinder head 112.

In the embodiment the air enters into cylinder 111 through inlet orifices 115 which may be provided with check valves formed by a deformable flap in the vicinity of the cylinder head 112 whereas the metered quantity of gas fuel in the metering auxiliary piston 118 enters the cylinder 111 through passages 116 before the opening of orifices 130, 131 upon the descent of the auxiliary piston 118, the fuel and the air thus present in the cylinder 111 in the form of a premixture.

The intimate mixing of the air and fuel is effected by the displacement of the perforate plate 110 in association with the suction effect caused by the descent of the main piston 114. The continued descent of the perforate member 110 integral with the auxiliary piston 110 causes the premixture of air and fuel to rush through the orifices 117 at various orientations thereby producing criss-crossed streams of the mixture, intimately mixing the same as they pass from the underside of the perforate plate 110 to the top side thereof. This arrangement substantially improves the formation of the explosive mixture before its transfer to the combustion chamber.

Obviously the invention is not intended to be limited to the illustrated and described embodiments but on the contrary encompasses various alternatives and modifications without departing from the spirit and scope of the invention as defined by the appended claims.

What I claim is:

1. An internal combustion apparatus, said apparatus being of the intermittent operation type and comprising a cylinder, a stationary cylinder head arranged in said cylinder, a main operating piston reciprocable in said cylinder, resilient means for biasing said main piston toward a first or rest position, said main piston being adapted to be driven from its first position to an operating position in response to intermittent ignition of an explosive mixture, said main piston being operatively connected to an operating member, the improvement comprising a plunger reciprocably mounted for operation independently of said main piston in a principal chamber in said cylinder defined by a space formed between said main piston and said cylinder head between a top end of stroke position adjacent said cylinder head and a bottom end of stroke position remote from said cylinder head, said plunger having a tubular column extending through an aperture in said cylinder head and containing a fuel passage therein, means for biasing said plunger toward said top end of stroke position, inlet means for admitting gas fuel and inlet means for admitting combustion supporting gas into an admission chamber formed between said cylinder head and said plunger in the course of displacement of said plunger between said top end of stroke position and its bottom end of stroke position, and a combustion chamber defined between said main operating piston and said plunger during its displacement from its bottom end of stroke position and its top end of stroke position, and one-way flow path means provided on said plunger operative in the course of displacement of said plunger between its bottom end of stroke position and its top end of stroke position to transfer the explosive mixture of fuel and combustion supporting gas to said combustion chamber.

2. Apparatus according to claim 1, wherein said admission chamber and said combustion chamber are both defined within the principal chamber depending on the position and displacement of said plunger.

3. Apparatus according to claim 1, wherein the plunger comprises a disc having a perforate plate on its side facing said main operating piston, wherein orifices in said perforate plate are arranged in said one-way flow path means for intimately mixing fuel with said combustion supporting gas.

4. Apparatus according to claim 3, wherein said apertures in said perforate plate are nonparallel.

5. Apparatus according to claim 3, wherein contours of said apertures in said perforate plate are burred creating a turbulent flow of fuel and combustion supporting gas.

6. Apparatus according to claim 3, wherein said disc has a diameter smaller than that of the principal chamber in said cylinder, wherein said one-way flow path comprises a peripheral recess or groove formed in the edge of the disc partially accommodating a sealng member between said disc and said perforate plate, the outer diameter of said sealing member being greater than the inner diameter of said principal chamber in said cylinder, said sealing member bearing alternately against said disc and said perforate plate depending on the direction of stroke of said plunger.

7. Apparatus according to claim 1, wherein said tubular column is slidably mounted in said cylinder head, said tubular column carries a source of liquefied gas fuel.

8. Apparatus according to claim 7, wherein complementary latching means provided on said cylinder head and a fuel tank comprising said source of liquefied gas fuel are operative to latch said plunger in its bottom end of stroke position, a trigger operatively connected to said latching means for releasing said latching means, resilient means operatively arranged between said fuel tank and said cylinder head for biasing said fuel tank to a raised rest position.

9. Apparatus according to claim 7, wherein said plunger has central exhaust orifice, a valve member controlling the opening of said central exhaust orifice, and a push button operatively connected to said valve member.

10. Apparatus according to claim 9, wherein said push button has a tubular extension defining a fuel metering piston slidably mounted in an axially sleeve fixed relative to said tubular column and communicating with said source of liquefied gas fuel.

11. Apparatus according to claim 10, wherein said plunger has an axial extension extending in said tubular column, splines disposed between said axial extension and said tubular column for forming throttle passageways for fuel, said passageways being adapted to be brought into communication with said metering piston to transfer a metered quantity of fuel.

12. Apparatus according to claim 11, wherein the metering piston comprises an annular groove, said metering piston being axially displaceable between a first position in which said annular groove is in communication with said fuel supply tank and a second position in which said annular groove is in communication with said throttle passageways.

13. Apparatus according to claim 11, wherein an annular zone is formed between the valve rod and said axial extension of the plunger, said annular zone being adapted to be in communication with the atmosphere through a tubular member mechanically connecting said valve member to said push button.

14. An internal combustion apparatus comprising a cylinder, a cylinder head arranged in said cylinder, a main operating piston reciprocable in said cylinder, resilient means for biasing said main piston toward a first or rest position, said main piston being adapted to be driven from its first position to an operating position in response to ignition of an explosive mixture, said main piston being operatively connected to an operating member, the improvement comprising a plunger reciprocably mounted in a principal chamber in said cylinder defined by a space formed between said main piston and said cylinder head between a top end of stroke position and a bottom end of stroke position, inlet means for admitting gas fuel and inlet means for admitting combustion supporting gas into an admission chamber formed between said cylinder head and said plunger in the course of its displacement between said top end of stroke position and its bottom end of stroke position, and a combustion chamber defined between said main operating piston and said plunger during its displacement from its bottom end of stroke position and its top end of stroke position, and one-way flow path means provided on said plunger operative in the course of displacement of said plunger between its bottom end of stroke position and its top end of stroke position to transfer the explosive mixture of fuel and combustion supporting gas to said combustion chamber, said plunger having an axial extension slidable along tubular member fixed relative to said cylinder, and valve means connected to said source of fuel which is pressurized, said valve means having a first position to bring said source of fuel into communication with said tubular member and said extension on said plunger for displacing said plunger to its bottom end of stroke position, and a second position for transferring a metered quantity of gas fuel from said extension and said tubular element to said admission chamber.

15. Apparatus according to claim 14, further comprising exhaust valve means arranged on said principal chamber proximate to said operating piston in its raised position.

16. Apparatus according to claim 15, wherein said exhaust valve means is disposed radially of said cylinder and connected to a trigger adapted to control said first-mentioned valve means between said fuel source and said tubular member.

17. An internal combustion apparatus, said apparatus being of the intermittent operation type and comprising a cylinder having a stationary cylinder head, a main operating piston reciprocable in said cylinder, resilient means for biasing said piston to a first or rest position, said main piston being adapted to be driven from its first position to an operating position in response to ignition of an explosive mixture, said piston being operatively connected to an operating member, the improvement comprising a plunger receiprocably mounted for operation independently of said main piston in a principal chamber in said cylinder between a top end of stroke position and a bottom end of stroke position, said plunger having a tuburlar column extending through an aperture in said cylinder head and containing at least one throttle pasageway therein, means for biasing said plunger toward said top end of stroke position, a source of liquefied gas fuel, means for bringing said source of gas fuel in communication with a metering chamber, means for transferring the metered quantity of gas fuel to said throttle passageway, means for venting products of combustion from said principal chamber to the atmosphere via a passageway contiguous with said throttle passageway, means for controlling the venting of combustion production from the principal chamber and for simultaneously controlling the transfer of a metered quantity of gas fuel to the throttle passageway whereby the combustion gases vaporize the gas fuel in the throttle passageway before entering the principal chamber where the vaporized gas fuel is mixed with combustion supporting air and then ignited.

* * * * *